United States Patent [19]

Layher

[11] 4,426,171

[45] Jan. 17, 1984

[54] COUPLING FOR METALLIC SCAFFOLDS

[76] Inventor: Eberhard Layher, Blankenhornstrasse 17, D-7129 Güglingen-Eibensbach, (Württemberg), Fed. Rep. of Germany

[21] Appl. No.: 272,563

[22] Filed: Jun. 11, 1981

[30] Foreign Application Priority Data

Aug. 9, 1980 [DE] Fed. Rep. of Germany ..... 3030257

[51] Int. Cl.[3] ..... E04G 7/00; F16B 1/00

[52] U.S. Cl. ..... 403/49; 182/179; 248/225.4; 24/538

[58] Field of Search ..... 403/49, 384, 386, 385, 403/409; 248/225.4, 226.2, 316 B; 24/248 E, 251; 182/178, 179

[56] References Cited

U.S. PATENT DOCUMENTS 2,673,775 3/1954 Silverman ..... 403/409 X 3,179,212 4/1965 Gostling ..... 182/178 X 3,701,555 10/1972 Harris ..... 403/409 X

FOREIGN PATENT DOCUMENTS 2534927 2/1977 Fed. Rep. of Germany ..... 403/49

2234804 1/1975 France ..... 403/49

1537229 12/1978 United Kingdom ..... 403/49

*Primary Examiner*—Wayne L. Shedd

*Attorney, Agent, or Firm*—Michael J. Striker

[57] ABSTRACT

A coupling for clamping metallic scaffold tubes has two levers pivotally mounted on a common hinge and arranged to be locked by a wedge when they surround the scaffold tube. One of the levers is provided with a second hinge pivotally supporting a yoke which in turn supports the wedge. The thickened formations are provided on two opposite faces of the bars constituting the yoke, the formations preventing the wedge which is formed of sheet metal from slipping out of the yoke.

13 Claims, 4 Drawing Figures

COUPLING FOR METALLIC SCAFFOLDS

BACKGROUND OF THE INVENTION

The present invention relates to a coupling for scaffolds, working platforms, or similar structures. More particularly, the present invention, relates to a coupling which is provided with two levers connected to each other by means of a joint and adapted to clamp a metallic scaffold tube.

In the known structures of the couplings of the foregoing type the levers clamping the scaffold tube are locked on the tube by a wedge. The wedges utilized in the conventional couplings are normally made of cast iron. It has been recognized that the wedge of cast iron suitably formed for sliding movement in the coupling lock not only increases the weight of the construction but significantly increases costs of manufacturing of such installations.

SUMMARY OF THE INVENTION

Accordingly, it is an object of the invention to overcome the prior art disadvantages.

A more particular object of the invention is to provide an improved coupling for metallic scaffolds.

Still another object of the invention is to substantially reduce costs of manufacturing of the wedge-type couplings utilized for clamping metallic tubes of scaffolds.

These and other objects of the invention are attained by a coupling for scaffolds formed of tubes, comprising a first lever and a second lever, a first joint extending through the first and second levers which are pivotally mounted on said first joint and adapted to surround a scaffold tube to be clamped in a form-locking connection, a wedge having a longitudinal axis and arranged to lock said first and second levers on said scaffold tube upon the slidable movement of the wedge along said longitudinal axis; said wedge being formed of sheet metal, a yoke supporting the wedge; a second joint on the second lever and spaced from the first joint, said yoke being pivotally mounted on the second joint, and means for preventing the wedge from slipping out from the yoke.

The wedge may be formed by punching and the scaffold tubes are preferably metallic.

The first lever may be formed with a laterally open slot for engaging and guiding the yoke during its pivoting on the second joint.

The yoke may also be formed of sheet metal.

The problem encountered in the construction of the coupling having a sheet-metal wedge is how to prevent the slippage, and sequential lost, of the wedge out from the yoke during assembling and disassembling of the coupling and also during the storage thereof.

This problem has been solved by provision of the coupling with means for preventing slipping of the wedge out of the yoke; according to the invention this means may include at least one formation formed on at least one of the opposite bars of the yoke and adapted to lock the wedge when the coupling is in the locked position.

Two formations may be formed on two opposite inner faces of the bars constituting the yoke, which formations may be bulges, or bead-shaped projections.

The aforementioned formation may be of such dimension that it prevents the wider end of the wedge from slipping out from the yoke.

In accordance with further features of the invention the narrower end of the wedge may be provided with a blind rivet which prevents the slippage of the narrower end of the wedge out of the yoke. The blind rivet may be substituted by a bifurcated end section on the narrower end of the wedge provided with a splint.

The coupling may be further provided with a metallic ring situated between the outer surface of the first lever and the wedge, the ring supporting the wedge in the assembly.

The aforementioned formation may have an apex projecting from the inner face of the bar and may be so dimensioned that the distance between said apex and the inner face of the opposite bar is narrower than the thickness of the material of the wedge.

The formation or two formations may be formed on the lateral faces of the bars constituting the yoke, these formations supporting the metallic ring when the wedge is in its locked position. These formations may have a nose-shaped or shoulder-shaped configuration.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
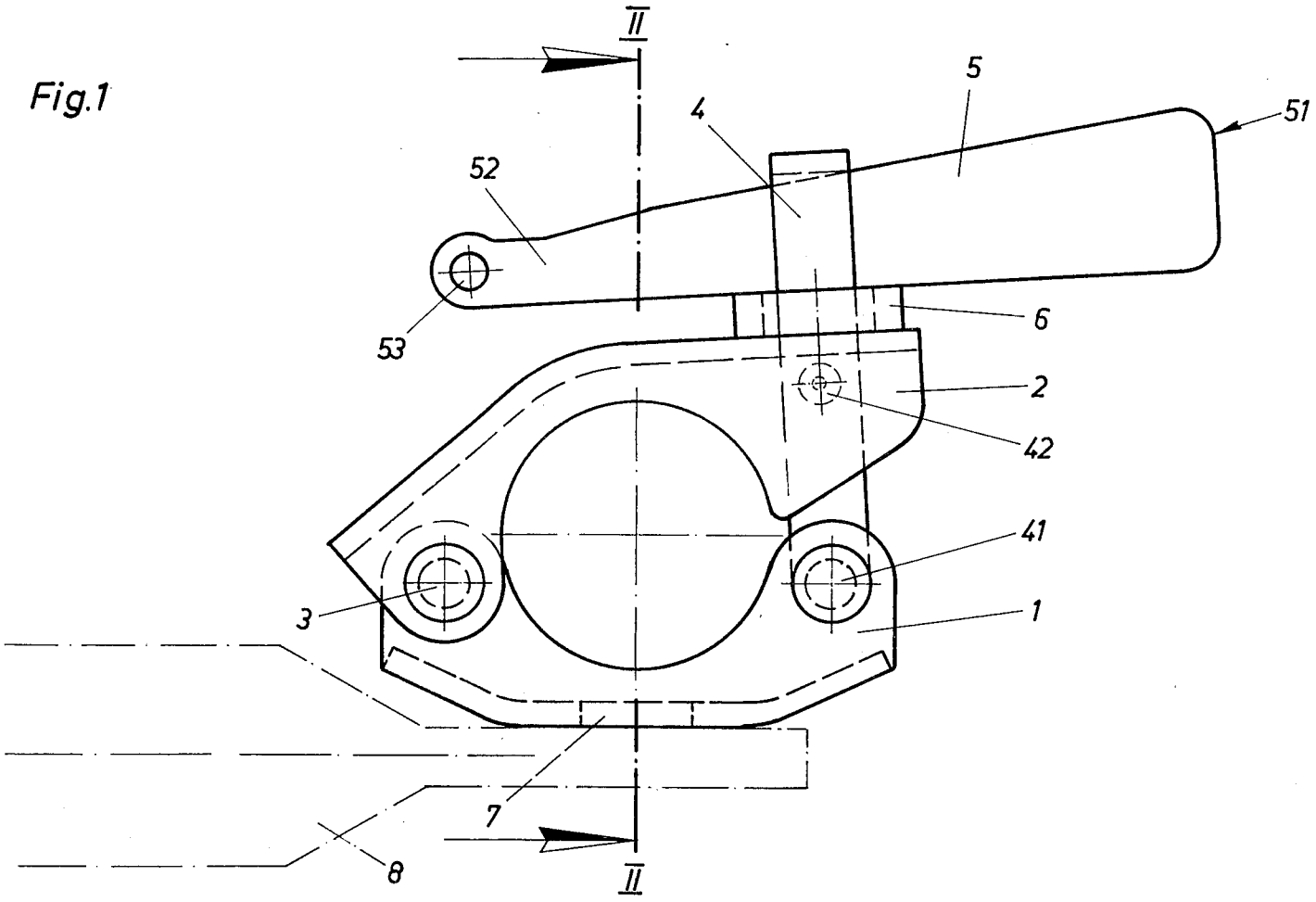
FIG. 1 is an elevational view of a coupling according to the invention.
Figure 2:
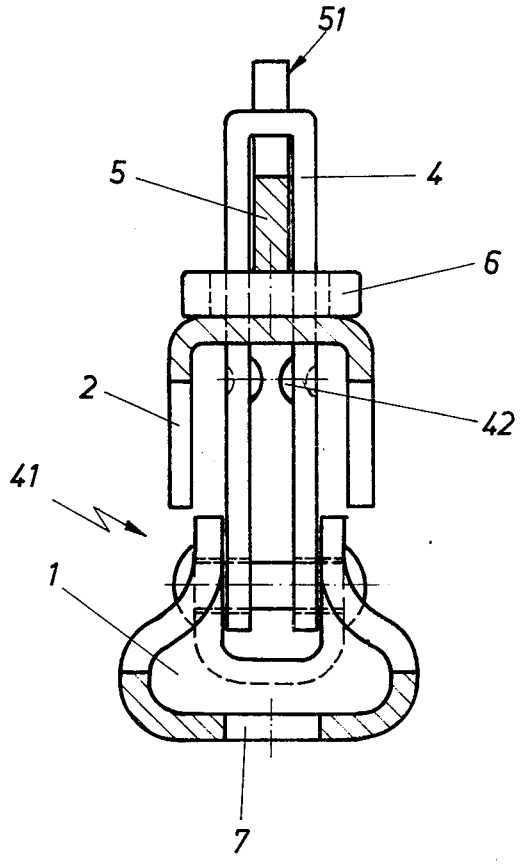
FIG. 2 is a sectional view on line II—II of FIG. 2.

The coupling for clamping a scaffold tube illustrated in FIG. 1 includes a first coupling lever 1 and a second coupling lever 2. For the sake of convenience lever 1 will be identified as a lower lever and lever 2 as an upper lever. The upper lever 2 and the lower lever 1 are interconnected by a pin 3 on which they are pivotally supported. The levers 1 and 2 are so dimensioned that when unlocked they pivot in a direction away from a scaffold tube (not shown) and in the locked position they surround the tube in a form-locking connection.

The coupling under consideration is most suited for metallic scaffold tubes.

The lower lever 1 is provided with a pin 41 which extends through openings 41' (FIGS. 3 and 4) of a U-shaped yoke 4 which is pivotally mounted on the pin 41. The yoke 4 having two opposite parallel bars supports a wedge 5 formed of sheet metal, preferably by punching. The wedge 5 is adapted to slide along the longitudinal axis thereof due to external force exerted thereupon. It is understood that the wedge 4 in a certain position locks the levers 1 and 2 surrounding the scaffold tube.

The yoke 4 also formed of sheet metal for example, by means of punching or stamping, is provided, in accordance with the preferred embodiment of the invention, with two opposite bead-like projections 42 formed on the inner opposite faces of the bars of the yoke and having apexes projecting towards each other. These projections are so dimensioned that the distance between two opposite apexes is narrower than the thickness of the material of the wedge. The projections 42 are so formed that the internal distance between the inner surface of the yoke and the projections 42 is smaller than the size of the wide end side 51 of wedge 5. Due to such construction the wide end portion 51 of the wedge is prevented from slipping out of the yoke 4. Only one projection of suitable size may be formed on one inner face of yoke 4 in place of two oppositely positioned beads.

The size of such projection should be sufficiently large to prevent the wide end side 51 of wedge 5 from slipping out of the yoke.

In order to prevent the slippage of a narrow end side 52 of wedge 5 out from yoke 4 the narrow side 52 may be provided with a blind rivet 53 of such dimension that the whole thickness of the narrow end portion of the wedge will be larger than the interior distance between the inner faces of the bars of yoke 4 supporting the wedge.

The upper coupling lever 2 is formed with an outwardly open slot in which the yoke 4 is guided in its pivoting movement about the pin 41. Advantageously, a ring 6 is placed between the outer surface of lever 2 and wedge 5, which ring surrounds the yoke 4 and supports wedge 5 during its slidable movement towards the locking position.

The lower coupling lever 1 is provided with a bore 7 which serves for connecting of one coupling with another coupling which in turn serves for clamping a neighboring scaffold tube. For this purpose, for example, a bar 8 may be used which has a tongue-shaped end illustrated in FIG. 1 in dotted line. The bar 8 may be turned in any suitable direction to connect the coupling to the neighboring coupling.

Should the coupling be opened the wedge is forced by a worker towards the wide end side 51 so that the wedgesupporting yoke 4 during its pivoting on pin 41 slides outwardly of the afore-mentioned open slot provided in lever 2. The wedge 5 is, however at this time prevented from falling out of yoke 4 due to the provision of blind rivet 53 at the narrow end side 52 of the wedge. At the same time due to the narrowing between the inner faces of yoke 4 in the area of formations 42 the wedge can, by manipulation of the worker, without any obstacles, slide in a direction towards the pin 41.

Figure 4:
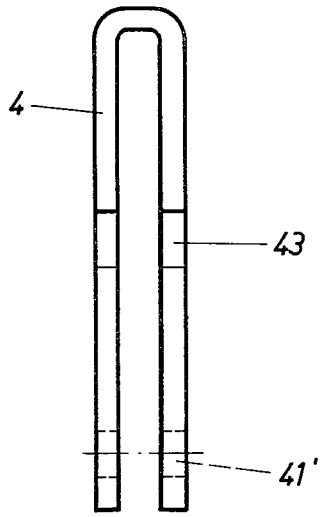
FIG. 4 is an elevational view of the yoke shown in FIG. 3.
Figure 3:
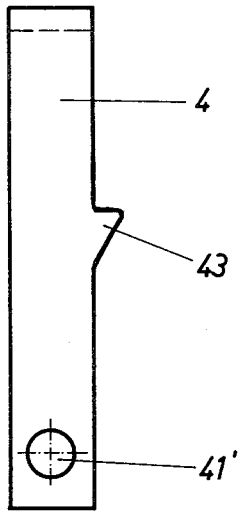
FIG. 3 is a front view of a yoke according to a modified embodiment of the present invention.

In order to prevent the sliding of ring 6 towards the pin 41 a suitable formation on the yoke 4 may be provided. Such formation is illustrated in FIGS. 3 and 4.

In place of projections 42, in another embodiment of the invention the yoke 4 may be provided with one or two nose-like projections 43 formed on the lateral sides of two opposite bars of the yoke. The projections 43 restrict the movement of ring 6 towards pin 41 whereby the possibility of sliding of the wedge 5 in the longitudinal direction is totally prevented.

The narrower end portion 52 of wedge 5 instead of having the blind rivet 53 may be twisted about 90° so that the twisted end portion will as well as the blind rivet prevent the slippage of wedge 5 out of yoke 4. Alternately, the end portion 52 may be provided with a bifurcated end section having two parts connected by a splint.

It will be understood that each of the elements described above, or two or more together, may also find a useful application in other types of couplings differing from the types described above.

While the invention has been illustrated and described as embodied in a coupling, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A coupling for scaffolds formed of tubes, comprising a first lever and a second lever; a first pin extending through said first lever and said second lever; a second pin mounted on said second lever and spaced from said first pin; said first lever and said second lever being pivotally mounted on said first pin and adapted to surround a scaffold tube to be clamped between said first and second levers in a form-locking connection; a yoke formed of sheet metal and pivotally mounted on said second pin, said first lever being formed with an outwardly open slot for engaging and guiding said yoke during its pivoting on said second pin; said yoke including two opposite bars spaced from each other and having inner faces; a wedge formed of sheet metal and having a longitudinal axis, said wedge being engaged between said inner faces of said bars and being slidably movable therebetween along said longitudinal axis, said wedge being adapted to lock said first and second levers on said scaffold tube upon the slidable movement of the wedge; and means for preventing said wedge from slipping out from said yoke, said means including at least one projection formed on at least one of said opposite bars.

2. The coupling of claim 1, wherein two of said projections are formed on the opposite inner faces of said bars.

3. The coupling of claim 1, wherein said preventing means further comprise means on the narrower end of said wedge and being of a thickness larger than the distance between said opposite bars so as to prevent the narrower end of the wedge from slipping out from said yoke.

4. The coupling of claim 3, wherein said means on the narrower end include a blind rivet mounted on said narrower end.

5. The coupling of claim 3, wherein said means on said narrower end include a bifurcated end section.

6. The coupling of claim 1, further including a ring situated between said wedge and said first lever, said ring surrounding said yoke and supporting said wedge.

7. The coupling of claim 1, wherein said one projection has an apex projecting from said inner face of said bar and is so dimensioned that the distance between said apex and the inner face of the opposite bar is narrower than the thickness of the material of said wedge.

8. The coupling of claim 2, wherein said projections project towards each other to form a clearance therebetween which is narrower than the thickness of the material of said wedge.

9. The coupling of claim 6, wherein said two opposite bars each has a lateral face, said at least one projection being formed on said lateral face of at least one bar and supporting said ring when the wedge is in its locked position.

10. The coupling of claim 1, wherein said wedge is made of punched sheet metal.

11. The coupling of claim 1, wherein said scaffold tubes are metallic.

12. The coupling of claim 9, wherein said ring is metallic.

13. The coupling of claim 3, wherein said means on said narrower end include an end portion twisted about said longitudinal axis.

* * * * *